US005729924A

United States Patent [19]

Reading

[11] Patent Number: 5,729,924

[45] Date of Patent: Mar. 24, 1998

[54] ILLUMINATING SIGN ASSEMBLY

[76] Inventor: Charles J. Reading, 1703 Shelby Rd., Kings Mountain, N.C. 28086

[21] Appl. No.: 621,440

[22] Filed: Mar. 25, 1996

[51] Int. Cl.[6] ..... G09F 13/04

[52] U.S. Cl. ..... 40/564; 40/572; 40/574; 40/575; 362/183

[58] Field of Search ..... 40/564, 572, 574, 40/575, 573; 362/183, 812

[56] References Cited

U.S. PATENT DOCUMENTS

| | | | |
|---|---|---|---|
| 1,724,243 | 8/1929 | Willey | 40/572 X |
| 2,699,620 | 1/1955 | Smythe | 40/564 X |
| 4,384,317 | 5/1983 | Stackpole | 362/183 |
| 4,611,265 | 9/1986 | Davis | 362/812 X |
| 4,674,211 | 6/1987 | Pratt | 40/564 |
| 4,718,185 | 1/1988 | Conlin et al. | 362/183 X |
| 4,751,622 | 6/1988 | Williams | 362/183 |
| 4,835,664 | 5/1989 | Wen | 362/183 |
| 4,843,525 | 6/1989 | Williams | 40/564 X |
| 4,903,172 | 2/1990 | Schoniger et al. | 362/183 X |
| 4,903,423 | 2/1990 | Hinca | 40/574 X |
| 5,007,190 | 4/1991 | Shyu | 40/564 |
| 5,025,355 | 6/1991 | Harwood | 362/812 X |
| 5,065,291 | 11/1991 | Frost et al. | 362/183 |
| 5,101,329 | 3/1992 | Doyle | 362/183 |
| 5,329,716 | 7/1994 | Fite | 362/183 X |
| 5,426,879 | 6/1995 | Hecker | 40/564 X |
| 5,435,087 | 7/1995 | Karkar et al. | 40/564 X |
| 5,573,328 | 11/1996 | Hwang | 362/183 |

FOREIGN PATENT DOCUMENTS

| | | | |
|---|---|---|---|
| 2183387 | 6/1987 | United Kingdom | 40/564 |

OTHER PUBLICATIONS

Atlantic Solar Products, Inc.; "M-2 Ultra Low Overhead Charge Controller"; p. 1; This reference was published prior to the filing date of the above-referenced application.; No place of publication is provided.

Atlantic Solar Products, Inc.; "Uni-solar. Utility Power Module and Flexible Solar Battery Charger"; pp. 1-12; This reference was published prior to the filing date of the above-referenced application.; Baltimore, Maryland.

SCI; "Charge Regulators"; p. 21; This reference was published prior to the filing date of the above-referenced application.; No place if publication is provided.

"KW/2 Lighting Products, Division of Solar Kinetics,Inc.; KW/2 Cost Effective, Leading Edge Products that Address Today's Escalating Energy Costs"; pp. 1-4; This reference was published prior to the filing date of the above-referenced application.; Dallas, Texas.

Verilux, Inc.; "Verilux, Inc. Brings You a World Of Healthy Lighting"; pp. 1-6; This reference was published prior to the filing date of the above-referenced application.; Stamford, Connecticut.

*Primary Examiner*—Anthony Knight
*Assistant Examiner*—Andrea Chop
*Attorney, Agent, or Firm*—Adams Law Firm, P.A.

[57] ABSTRACT

An illuminating sign assembly includes a sign housing for receiving and supporting a sign, and a bulb located within the housing which automatically activates to illuminate the sign at night. A rechargeable battery is connected to the bulb for supplying an operating electrical current to the bulb. A solar cell is connected to the battery, and operates to convert light to electrical energy to be stored in the battery for discharge to the bulb.

10 Claims, 5 Drawing Sheets

ILLUMINATING SIGN ASSEMBLY

TECHNICAL FIELD AND BACKGROUND OF THE INVENTION

This invention relates to an illuminating sign assembly. The invention is particularly applicable for advertising small businesses, such as real estate companies, which commonly post temporary signs in the ground to display information to potential customers or purchasers. In an alternative application, for example, the invention is used to illuminate a restaurant menu located outside of the restaurant for display during evening hours.

The present sign assembly does not require an extended-length power supply cord and utility outlet, but instead utilizes solar energy from the sun to charge a conventional battery. The battery supplies the necessary operating electrical current to a fluorescent bulb which illuminates the sign insert. The bulb is connected to a light sensor which automatically activates the bulb upon sensing a predetermined degree of darkness, and deactivates the bulb in daylight conditions. The sign assembly is relatively lightweight, and may be conveniently placed in virtually any location exposed to the sun. Moreover, the sign assembly is constructed according to any desired dimensions, is operable without any supervision of the sign owner, and requires little maintenance.

Unlike conventional illuminating neon signs, the signs used with the present invention are common, flat cardboard or plastic signs which are readily interchangeable by the sign owner as often as desired. The visual effect of the sign is not created by a series of permanently arranged lights, but instead is created by the replaceable and inexpensive sign insert itself. Thus, the sign is readily visible during daylight hours without illumination of the bulb.

SUMMARY OF THE INVENTION

Therefore, it is an object of the invention to provide an illuminating sign assembly which utilizes solar energy.

It is another object of the invention to provide a sign assembly which includes an inexpensive and readily interchangeable sign insert that is visible when illuminated during night hours, and when not illuminated during daylight hours.

It is another object of the invention to provide a sign assembly which is automatically operable without supervision by the sign owner.

It is another object of the invention to provide sign assembly which requires little maintenance.

It is another object of the invention to provide a sign assembly which is relatively light weight and portable.

It is another object of the invention to provide a sign assembly which is a self-contained single modular unit.

It is another object of the invention to provide a sign assembly which is relatively inexpensive to manufacture and operate.

These and other objects of the present invention are achieved in the preferred embodiments disclosed below by providing an illuminating sign assembly including a sign housing for receiving and supporting a sign to be illuminated. A bulb is located within the housing for illuminating the sign. A rechargeable battery is connected to the bulb, and supplies an operating electrical current to the bulb. A solar cell is connected to the battery, and operates to convert light to electrical energy to be stored in the battery for discharge to the bulb.

According to one preferred embodiment of the invention, an electrical charge controller is connected to the solar cell and the battery to prevent an overflow of electrical current to the battery.

According to another preferred embodiment of the invention, a low voltage disconnector is connected to the battery and the ballast for interrupting the discharge of current to the bulb when the battery approaches a predetermined low voltage.

According to yet another preferred embodiment of the invention, a light sensor is connected to the bulb for controlling the discharge of operating current to the bulb. In the absence of daylight conditions, the bulb is operative to illuminate the sign. In the presence of daylight conditions, the bulb is inoperative.

According to yet another preferred embodiment of the invention, the solar cell is a relatively flat and flexible electric-utility grade solar module carried by the housing.

In an another preferred embodiment, the illuminating sign assembly includes a sign housing with a hollow base, and a frame attached to the base for receiving and supporting a sign to be illuminated. A bulb is located within the base of the housing for illuminating the sign. A rechargeable battery is located within the base in close proximity to the bulb. The battery is connected to the bulb for supplying the bulb with an operating electrical current. A solar cell is carried by the housing, and connected to the battery for converting light to electrical energy to be stored in the battery for discharge to the bulb.

According to one preferred embodiment of the invention, the frame includes opposing, spaced-part side walls having respective longitudinally-extending grooves for engaging opposite side edges of the sign to support the sign in an upright condition.

According to another preferred embodiment of the invention, spaced-apart transparent front and rear walls are supported by the side walls of the frame, and reside on opposite faces of the sign.

According to yet another preferred embodiment of the invention, a top cap is removably attached to a top end of the frame.

According to yet another preferred embodiment of the invention, the bulb is an elongated fluorescent bulb extending lengthwise between the opposing side walls of the frame.

According to yet another preferred embodiment of the invention, an elongated bottom reflector is positioned adjacent to an underside of the fluorescent bulb, and extends between the side walls of the frame for reflecting light upwardly in a direction of the sign.

According to yet another preferred embodiment of the invention, an elongated top reflector is positioned adjacent to a top end of the frame, and cooperates with the bottom reflector to uniformly illuminate the sign from a top and bottom end thereof.

According to yet another preferred embodiment of the invention, a base cap is attached to a bottom end of the base.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
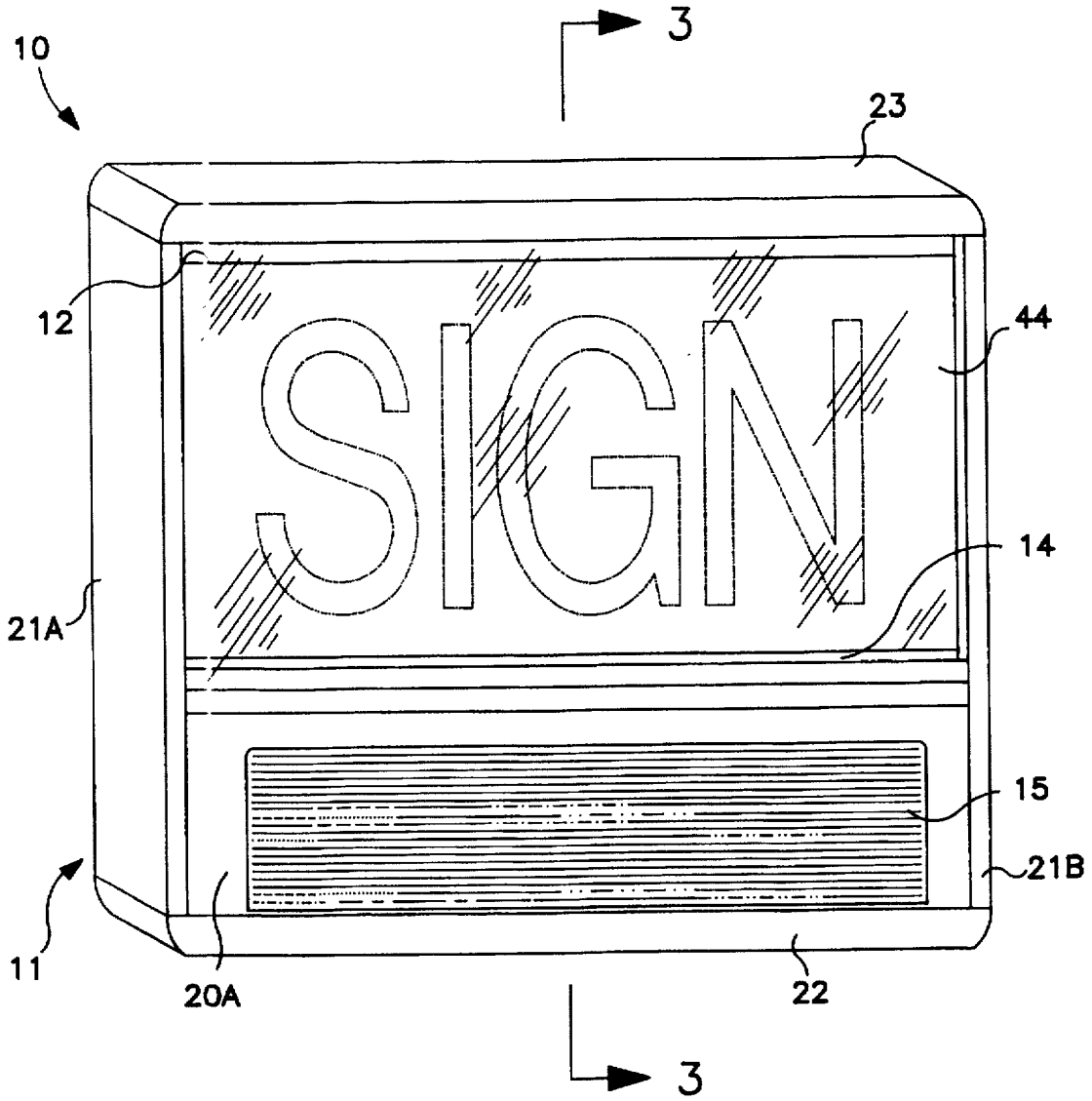
FIG. 1 is a front perspective view of the sign assembly according to one preferred embodiment of the invention.

Referring now specifically to the drawings, an illuminating sign assembly according to the present invention is illustrated in FIG. 1 and shown generally at reference numeral 10. The sign assembly 10 is particularly useful to businesses, such as real estate companies, which commonly post temporary signs in the ground for advertising. The sign assembly 10 includes a portable housing 11 for receiving and supporting a removable sign 12. A bulb, for example, an elongated fluorescent bulb 14, is located within the housing 11 for illuminating the sign 12 during selected night hours. A solar cell module 15 converts light energy into electrical energy necessary to operate the sign assembly 10. Operation of the sign assembly 10 is described further below.

Figure 2:
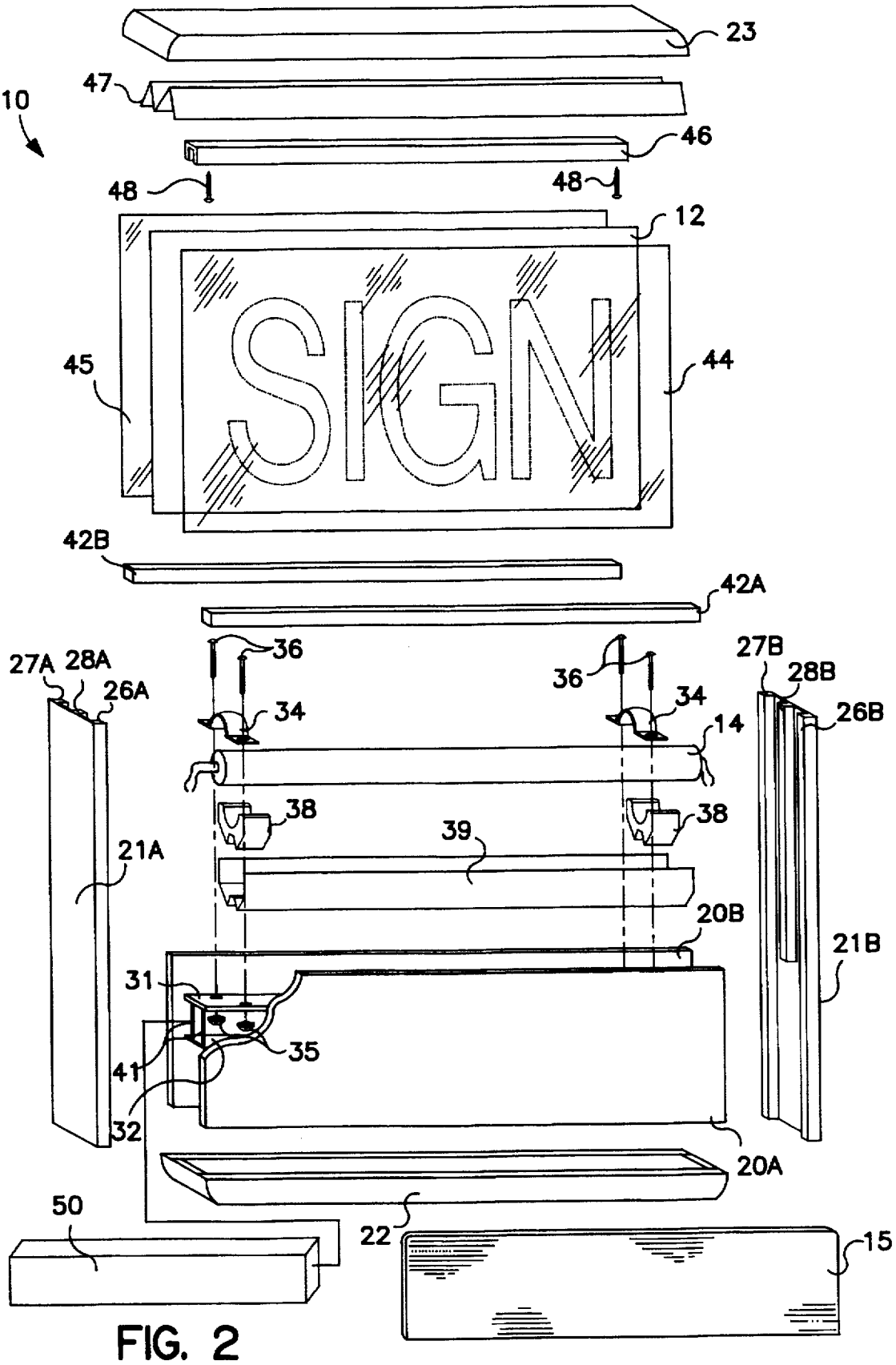
FIG. 2 is an exploded perspective view of the sign assembly.
Figure 3:
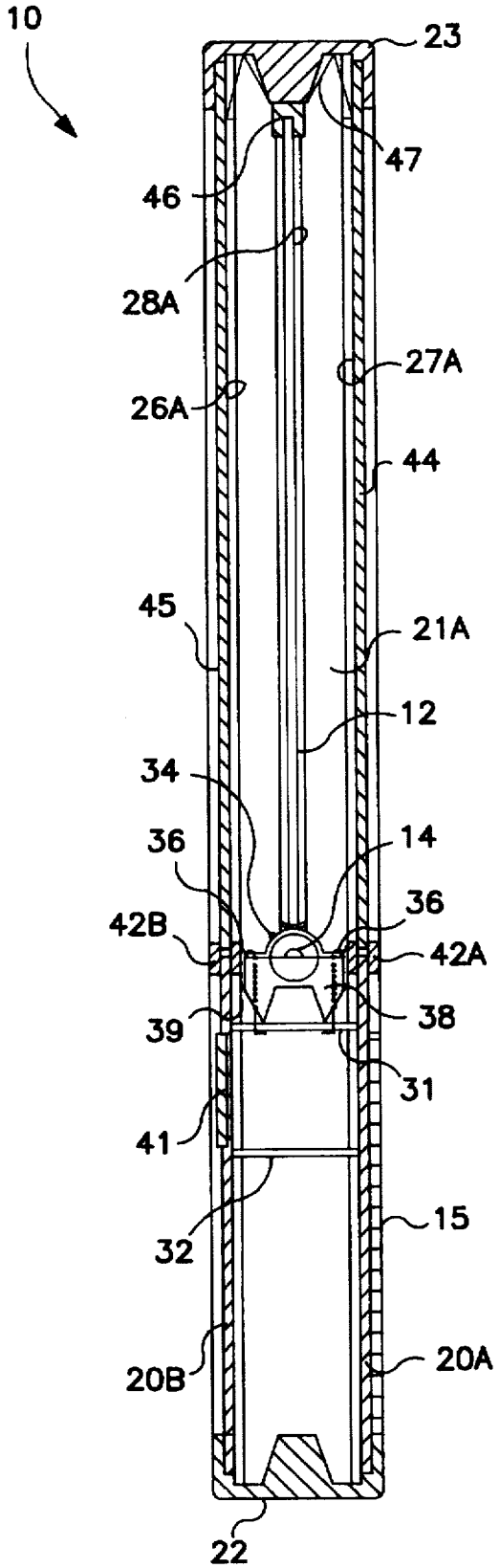
FIG. 3 is a cross-sectional view taken substantially along line 3—3 of FIG. 1.
Figure 4:
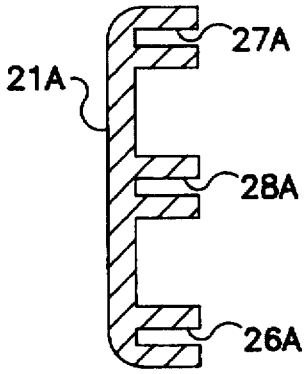
FIG. 4 is a cross-sectional view of a side wall of the sign housing taken along a lateral dimension thereof.

Referring to FIGS. 2–4, the housing 11 includes front and rear base panels 20A and 20B, side walls 21A and 21B, a base cap 22, and a removable top cap 23. The side walls 21A, 21B have respective longitudinally-extending outer channels 26A, 27A and 26B, 27B for receiving and supporting the base panels 20A and 20B, and respective center channels 28A and 28B defining a frame for receiving and supporting the sign 12. The center channels 28A, 28B preferably extend from a top end of the side walls 21A, 21B to a point generally adjacent to the top of the base panels 20A, 20B. Respective bottom ends of the center channels 28A, 28B are closed to vertically support the sign 12 within the housing 11. The sign 12 is formed of any conventional cardboard sheet stock or molded plastic material.

Top and bottom compartment walls 31 and 32 are located between the base panels 20A and 20B, and define an open compartment area for storing the electronic components of the sign assembly 10. According to one embodiment, the bottom compartment wall 32 is permanently attached to the panels 20A and 20B by welding. The top compartment wall 31 is preferably removably supported above the bottom wall 32 by angle brackets, vertical spacers, or other suitable means.

Figure 5:
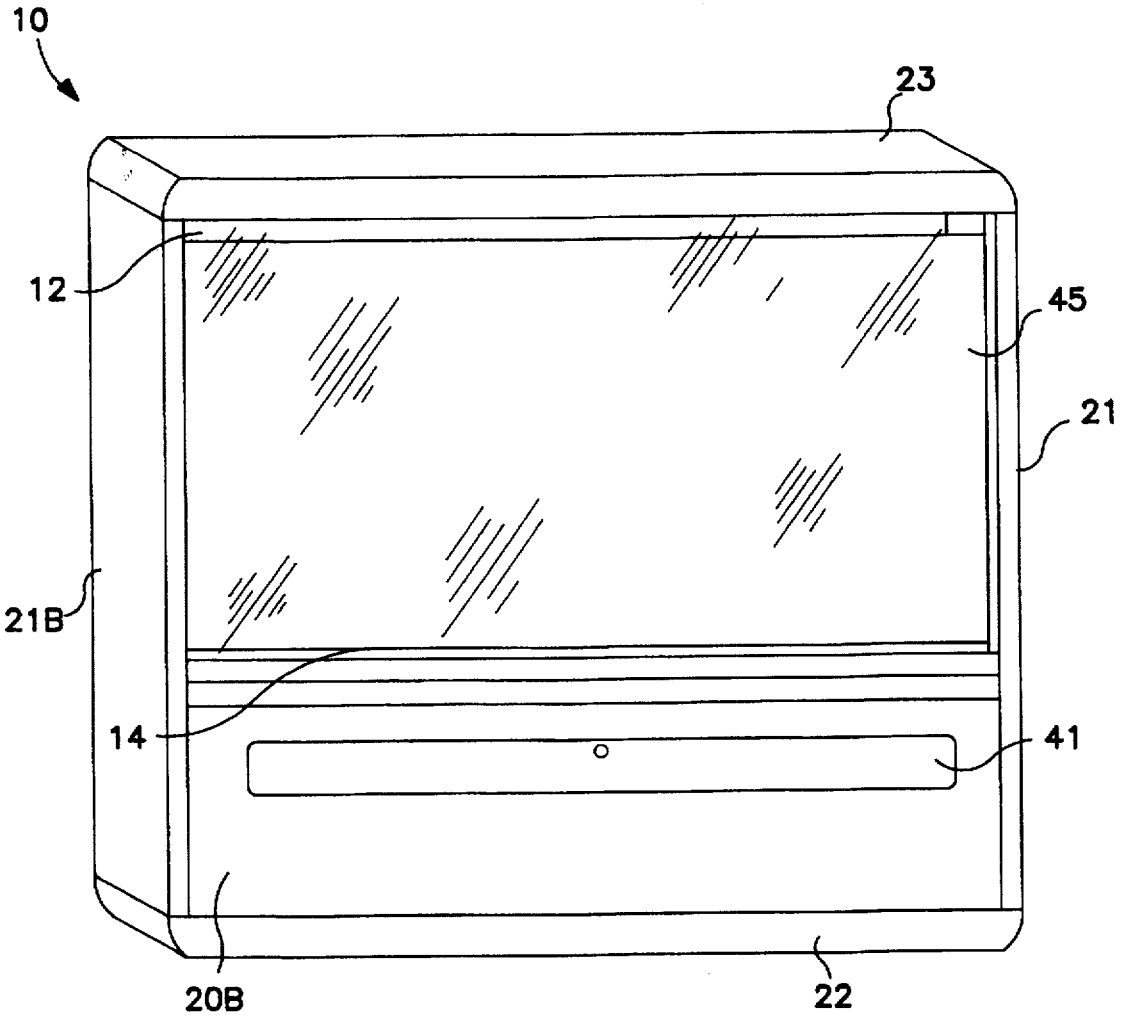
FIG. 5 is a rear perspective view of the sign assembly.

The bulb 14 is secured to the top compartment wall 31 with brackets 34 and complementary threaded nuts 35 and bolts 36. The bulb 14 is carried by extruded spacers 38, and positioned adjacent to an angled reflector 39 for reflecting light from the bulb 14 upwardly in a direction of the sign 12. The bolts 36 pass through each of the brackets 34, spacers 38, and reflector 39 to mount these elements directly to the top compartment wall 31. The top compartment wall 31 is removable from the housing 11 through a hinged access door 41, shown in FIG. 5, to permit safe and convenient re-lamping and other necessary maintenance of the bulb A pair of teflon coated H-channels 42A and 42B are located on respective top edges of the front and rear base panels 20A and 20B, and engage respective bottom edges of front and rear transparent walls 44 and 45. The transparent walls 44 and 45 reside on opposite faces of the sign 12, and serve to protect the sign 12 and bulb 14 from weather damage. The transparent walls 44 and 45 are preferably constructed of plastic, glass, or plexiglass.

As shown in FIGS. 2 and 4, a top channel 46 and second angled reflector 47 are attached to the underside of the removable top cap 23 using screws 48 or other fasteners. The channel 46 engages a top edge of the sign 12 to further support sign 12 within the housing 11. The top reflector 47 cooperates with the bottom reflector 39 and fluorescent bulb 14 to fully and uniformly illuminate the sign 12 during night hours. With the top cap 23 removed, the sign 12 is readily interchangeable with other signs.

Operation of the Sign Assembly 10

Figure 6:
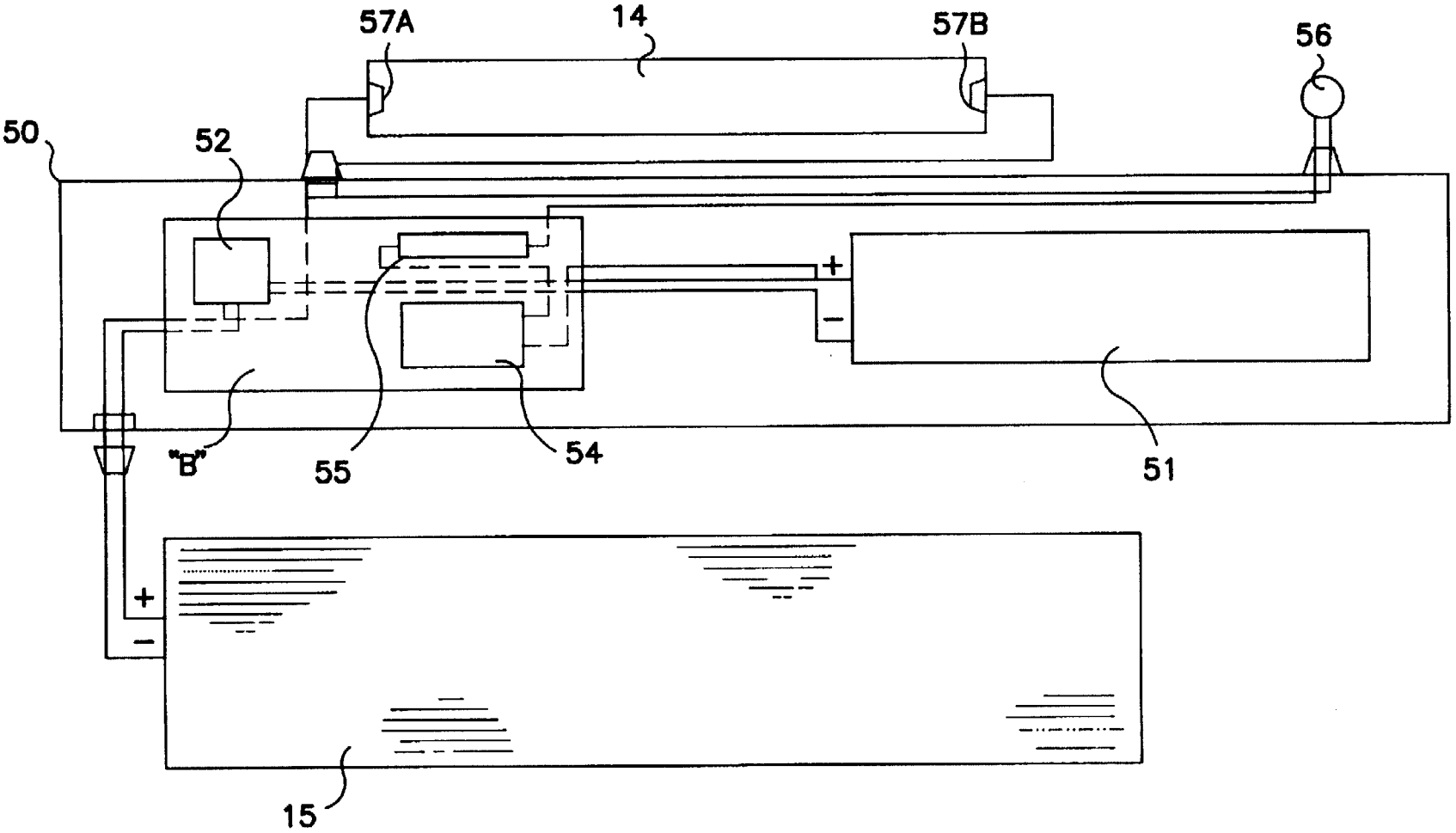
FIG. 6 is a schematic showing the interior components of the sealed electronic module.

Referring to FIGS. 2 and 6, the solar cell module 15 is mounted to the front base panel 20A of the housing 11, and includes electrical wires leading to a sealed electronic module 50 received within the open compartment area of the housing 11. The electronic module 50 electrically interconnects the solar cell module 15 and the fluorescent bulb 14, and supplies an operating electrical current to the bulb 14 during selected night hours. During daylight hours, the solar cell module 15 receives and converts light energy from the sun into electrical current which is transferred to and stored in a conventional DC battery 51 contained in the electronic module 50. According to one embodiment, the solar cell module 15 is an electric-utility grade solar module sold by Atlantic Solar Products, Inc. of Baltimore, Md. under the trademark "UNI-SOLAR". The approximate dimensions of the "UNI-SOLAR LM-603" flexible module are 14.3×7.6×0.07 inches. The weight is approximately 0.4 lbs.

As shown schematically in FIG. 6, the wires of the solar cell module 15 terminate into a molded plug which is removably inserted into an outlet of the electronic module 50. The electrical current generated by the solar cell module 15 passes directly to a charge controller 52. The charge controller 52 is electrically connected to the battery 51, and operates to prevent overcharging of the battery 51 without significant power loss through the controller. According to one embodiment, the charge controller 52 is a "Sun Selector M-2" device sold by Atlantic Solar Products. The nominal input current rating of this device is 2 amps (up to 4 amps surge), and the maximum input VOC is 40 VDC.

The battery 51 is electrically connected to a low voltage disconnector 54 which serves to interrupt the flow of electrical current from the battery 51 when the charge reaches a predetermined low voltage. This protects the battery 51 from deep discharge damage. When the battery 51 is sufficiently charged, current passes from the disconnector 54 to an electronic tube ballast 55. The ballast 55 receives current from the battery 51, and generates an increased current sufficient for activating electrodes 57A and 57B of the fluorescent bulb 14. The charge controller 52, low-voltage disconnector 54, and ballast 55 are preferably mounted on an electronic board "B".

A remote light sensor 56 is electrically positioned between the tube ballast 55 and the electrodes 57A, 57B to manage the discharge of current from the ballast 55 to the bulb 14 upon sensing a predetermined darkness/lightness. In dark conditions, the light sensor 56 automatically closes an electrical switch directing current from the ballast 55 to the electrodes 57A, 57B to charge the electrodes 57A, 57B and activate the fluorescent bulb 14. Light from the fluorescent bulb 14 is manipulated by the top and bottom reflectors 39 and 47 to fully and uniformly illuminate the sign 12, as described above. In light conditions, the light sensor 56 automatically opens the electrical switch to interrupt the flow of operating current to the bulb 14. Preferably, the sensitivity of the light sensor 56 is set such that the switch closes at dusk to activate the bulb 14, and opens at dawn to deactivate the bulb 14. The sign 12 thus remains illuminated and visible during night hours without any supervision of the sign owner.

The remote light sensor 56 preferably plugs directly into the electronic module 50, as indicated in FIG. 6. Alternatively, the light sensor 56 and low-voltage disconnector 54 are combined in a single unit stored within the electronic module 50. One such unit is that sold by Atlantic Solar Products as part number SCID Cat. #3008.

The fluorescent bulb 14 is preferably an 18-inch medium bi-pin tube sold by Verilux, Inc. of Stamford, Conn. under order code designation "F15T8VLX". For safety and convenience, electrical wires of the bulb 14 terminate into a standard molded plug which is received directly into the electronic module 50 for electrical connection to the ballast 55 and light sensor 56.

An illuminating sign assembly is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

I claim:

1. An illuminating sign assembly, comprising:

(a) a sign housing including a hollow base defined by walls, and a frame attached to the base for receiving and supporting a sign to be illuminated, said frame comprising opposing spaced-apart vertical side walls each having first and second spaced-apart longitudinally-extending side channels extending from a top of the side wall to a bottom of the side wall, and a longitudinally-extending center channel of reduced length relative to the side channels, the center channel being located between the side channels and extending from the top of the side wall to a point adjacent to a top wall of the base, the center channels of the respective side walls cooperating to support the sign in an upright condition above the base;

(b) transparent front and rear walls supported by said frame and received within the respective side channels of the side walls, said transparent front and rear walls defining respective opposing viewing surfaces on a front and rear of the sign assembly;

(c) a bulb mounted on the top wall of the base of said housing for illuminating the sign;

(d) a rechargeable battery connected to said bulb within the base of said housing for supplying an operating electrical current to said bulb; and (e) a solar cell connected to said battery for converting light to electrical energy to be stored in said battery for discharge to said bulb.

2. An illuminating sign assembly according to claim 1, and comprising an electrical charge controller connected to said solar cell and said battery to prevent overflow of electrical current to said battery.

3. An illuminating sign assembly according to claim 1, and comprising a low voltage disconnector connected to said battery and a ballast for interrupting the discharge of current to said bulb when said battery approaches a predetermined low voltage.

4. An illuminating sign assembly according to claim 1, and comprising a light sensor connected to said bulb for controlling the discharge of operating current to said bulb, such that in the absence of daylight conditions, said bulb is operative to illuminate the sign, and in the presence of daylight conditions, said bulb is inoperative.

5. An illuminating sign assembly according to claim 1, wherein said solar cell comprises a relatively flat and flexible electric-utility grade solar module carried by said housing.

6. An illuminating sign assembly according to claim 1, and comprising a top cap removably attached to a top end of said frame.

7. An illuminating sign assembly according to claim 1, wherein said bulb comprises an elongated fluorescent bulb extending lengthwise between the opposing side walls of said frame.

8. An illuminating sign assembly according to claim 1, and comprising an elongated bottom reflector positioned adjacent to an underside of said fluorescent bulb, and extending between the side walls of said frame for reflecting light upwardly in a direction of the sign.

9. An illuminating sign assembly according to claim 1, and comprising an elongated top reflector positioned adjacent to a top end of said frame, and cooperating with said bottom reflector to uniformly illuminate the sign from a top and bottom end thereof.

10. An illuminating sign assembly according to claim 1, and comprising a base cap attached to a bottom end of said base.

* * * * *